US006066395A

United States Patent [19]

Miyoshi et al.

[11] Patent Number: 6,066,395

[45] Date of Patent: May 23, 2000

[54] CHOPPED CARBON FIBERS AND A PRODUCTION PROCESS THERE OF

[75] Inventors: Toshiyuki Miyoshi; Haruo Obara; Keizo Ono; Tetsuyuki Kyono, all of Ehime, Japan

[73] Assignee: Toray Industries, Inc., Japan

[21] Appl. No.: 09/080,967

[22] Filed: May 19, 1998

[30] Foreign Application Priority Data

May 23, 1997 [JP] Japan ..... 9-150477
Jul. 11, 1997 [JP] Japan ..... 9-202561

[51] Int. Cl.[7] ..... B32B 9/00; D01F 9/12

[52] U.S. Cl. ..... 428/367; 428/390; 428/391; 423/447.1

[58] Field of Search ..... 428/367, 391, 428/390; 423/447.1

[56] References Cited

U.S. PATENT DOCUMENTS 5,030,435 7/1991 Kitamura et al. ..... 423/447.4
5,229,202 7/1993 Tomono et al. ..... 428/288
5,639,807 6/1997 Secrist et al. ..... 523/215

*Primary Examiner*—William Krynski
*Assistant Examiner*—Chris Cronin
*Attorney, Agent, or Firm*—Austin R. Miller

[57] ABSTRACT

A bundle of short chopped carbon fibers impregnated with a sizing agent, the short fiber bundle having an average weight per unit length of 1.7 to 4 mg/mm in the fiber length direction and a coefficient of variation of 30 to 60% in the distribution of weight per unit length in the fiber length direction.

7 Claims, 3 Drawing Sheets

CHOPPED CARBON FIBERS AND A PRODUCTION PROCESS THERE OF

BACKGROUND OF THE INVENTION

1. Field of the Invention

The present invention relates to chopped carbon fibers suitable for producing a carbon fiber reinforced resin with a thermoplastic resin as the matrix, and also to a production process thereof. Particularly, it relates to a bundle of chopped carbon fibers produced from carbon fibers having a large number of filaments and large total fineness (so-called large tow), and to a production process thereof. In more detail, it relates to a bundle of chopped carbon fibers having excellent handling convenience such as flowability and bundle integrity, useful as a reinforcing material of short fiber reinforced resin moldings, and to a production process thereof.

2. Description of the Related Arts

Since carbon fiber reinforced resins are excellent in strength, stiffness and dimensional stability compared to non-reinforced resins, they are widely used in various areas such as the office machine industry and the automobile industry. The demand for carbon fibers has been growing year after year, and is shifting from premium applications for aircraft, sporting goods, etc. to general industrial applications concerned with architecture, civil engineering and energy. So, the performance requirements for carbon fibers have become severe, and cost reduction is a major issue as important as higher performance. To meet such requirements, in recent years, carbon fibers (bundle) having a large number of filaments and large total fineness are being supplied to afford cost reduction.

Various methods are used for producing carbon fiber reinforced resins, and among them, the most popularly adopted method is to melt-knead about 3 to 10 mm long chopped carbon fibers together with resin pellets or resin powder by an extruder for pelletization (called the compounding process), and then to injection-mold the pellets into a product. The chopped carbon fibers used in such a process are usually bundled by a sizing agent for constant and stable supply, and the chopped carbon fibers bundled by the sizing agent are automatically continuously metered and supplied to an extruder by a screw feeder, etc.

An especially important property in that case is flowability, and unless that property is satisfied, the carbon fibers are blocked in the feeder hopper in an extreme case, not allowing processing.

In areas where powders are handled, it is known that the flowability of a powder in a hopper has correlation with various property values such as the coefficient of friction, the angle of repose, bulk density and form factor. For example, it is known that at a lower coefficient of friction, at a smaller angle of repose and at a higher bulk density, the flowability is higher. However, in the case of chopped fibers, the form factor of the chopped fibers more greatly affects these property values than in the case of a powder. So, for example, the angle of repose becomes varied, depending on measuring conditions, since an ideal conical form cannot be formed, and is affected by the size of the cone and the piling conditions (drop height, dropping velocity, etc.), and since also the measured value is affected by the quantity of the sample. After all, though property values can be judged to some extent, the final evaluation is effected by confirmation tests using the actual equipment in industrial production.

For improving the flowability and bundle integrity of chopped carbon fibers, various techniques are proposed in Japanese Patent Laid-Open (Kokai) Nos. 5-261729 and 5-261730, etc. in reference to publicly known powder handling techniques and techniques for glass fibers very similar to chopped carbon fibers. Chopped carbon fibers are larger than the grain size of a powder and are formed like rods or flakes, and carbon fibers are provided as a fiber bundle having a large number of filaments and large total fineness, unlike glass fibers processed after doubling fiber bundles that have a small number of filaments. So, the chopped carbon fibers are generally lower in flowability than chopped glass fibers. To replace chopped glass fibers in view of performance itself and cost performance, carbon fibers are required to have equivalent processability in the existing equipment to that of glass fibers without lowering productivity.

Conventional chopped carbon fibers have been produced from about 1,000 to 30,000 continuous filaments. However, for cost reduction of carbon fibers in recent years, a carbon fiber bundle having a larger number of filaments and larger total fineness than before is produced, and it becomes necessary to produce chopped fibers from such carbon fibers.

To produce a carbon fiber bundle having a larger number of filaments and larger total fineness, an original fiber bundle for producing the carbon fiber bundle is generally handled in a flat form for smoothly removing the reaction heat of oxidation.

A carbon fiber bundle having a large number of filaments and large total fineness has more flatness than the conventional carbon fiber bundle, and in addition, if the form of the carbon fiber bundle is flat, the sizing agent is likely to permeate deep inside the bundle. For these reasons, if a process similar to the conventional process adopted for a carbon fiber bundle consisting of 1,000 to 30,000 filaments is adopted for producing chopped carbon fibers, the flatness adopted in the production becomes greater.

On the other hand, if the form of the carbon fiber bundle is flat, the chopped carbon fibers have low flowability and poor bundle integrity, disadvantageously.

If the sectional form of the bundle is made more circular, the bulk density of the fiber bundle becomes higher, causing the sizing agent to be less likely to permeate the fiber bundle deep inside, hence the bundle integrity becomes irregular. Furthermore, the shear force acting in the compounding process is likely to be so large as to open the fibers, and fiber balls are likely to be formed, lowering flowability. Thus, in the transfer from the hopper of the compounding process to an extruder, such drawbacks as blocking are likely to occur.

As a general conventional method for obtaining chopped carbon fibers, at first carbon fibers (bundle) are immersed in a sizing agent, and bundled in a drying step, and subsequently the carbon fibers are chopped by a cutter in a continuous or discontinuous line.

On the other hand, as a general method for chopping glass fibers, a sizing agent is applied to melt-spun glass fibers, and the glass fibers are cut in a wet state, then being dried. If this method for chopping glass fibers is adopted, chopped fibers with higher bundle integrity can be easily obtained with a smaller amount of deposited sizing agent, and this method is adopted for carbon fibers in Japanese Patent Laid-Open (Kokai) Nos. 5-261729 and 5-261730. However, the carbon fiber bundle to be chopped by these techniques consists of about 12,000 filaments, and these techniques are not intended to process a carbon fiber bundle having a larger number of filaments and larger total fineness. Also for said chopped glass fibers, the fiber bundle in the step of applying a sizing agent consists of about 4,000 filaments, and it is not intended to process a thicker fiber bundle.

SUMMARY OF THE INVENTION

The present invention relates to a bundle of chopped carbon fibers excellent mainly in flowability and bundle integrity, used for making a carbon fiber reinforced composite.

In more detail, the present invention is intended to solve such problems as the necessity of using a cost-effective carbon fiber bundle having a larger number of filaments and larger total fineness as a raw material, and the decline of flowability and bundle integrity of chopped carbon fibers caused by the high flatness involved in the use of the cost-effective carbon fiber bundle.

The inventors studied variously to solve the above problems, and as a result, completed the present invention.

The chopped carbon fiber bundles of the present invention comprise a set of chopped carbon fibers impregnated with a sizing agent, the short fiber bundle pieces constituting a set having an average weight per unit length of 1.7 to 4 mg/mm in the fiber length direction and a coefficient of variation of 30 to 60% in the distribution of weight per unit length in the fiber length direction.

A preferable process for producing the chopped carbon fibers of the present invention comprises the steps of applying a sizing agent as a water dispersed sizing agent to a continuous carbon fiber bundle consisting of 20,000 to 150,000 filaments, controlling the packing density in a range of 5,000 to 20,000 D/mm, cutting the carbon fiber bundle in a wet state of 10 to 35 wt % in solution content at the time of cutting, and drying with vibration at a solution content of 15 to 45 wt % before drying.

BRIEF DESCRIPTION OF THE DRAWINGS

FIGS. 2-1 and 2-2 are graphs showing the results of property evaluation in Example 3.

FIGS. 3-1 and 3-2 are graphs showing the results of property evaluation in Comparative Example 1.

DETAILED DESCRIPTION OF THE INVENTION

Figure 1:
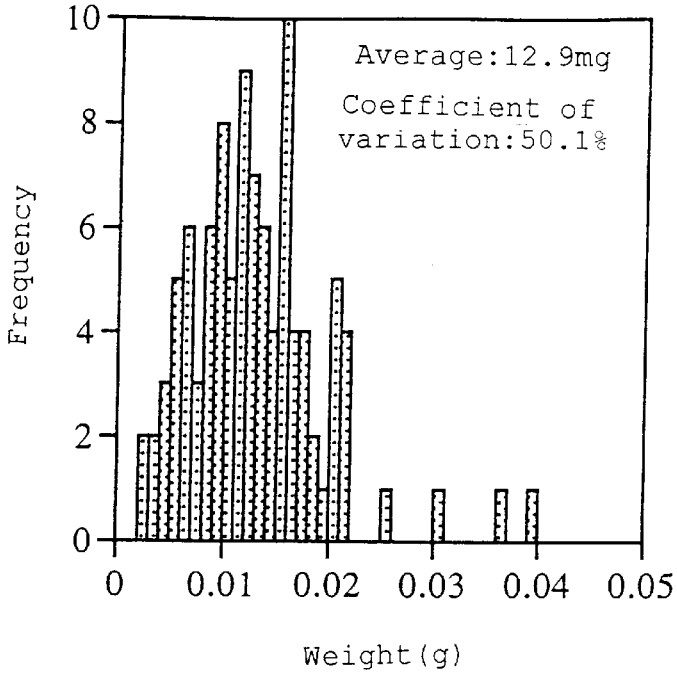
FIGS. 1-1 and 1-2 are graphs showing the results of property evaluation in Example 2.

In the present invention, general purpose carbon fibers with a strength of 2,000 to 7,000 MPa and an elastic modulus of 150 to 500 GPa are usually used, but the present invention is not limited thereto or thereby.

The carbon fiber bundle used in the process for producing chopped carbon fibers of the present invention can be a multi-filament carbon fiber bundle consisting of 20,000 to 150,000 filaments with a single filament fineness of 0.3 to 2.0 deniers, preferably 0.6 to 1.0 denier. Carbon fibers having twist of 0~10 turns/m can be used. The carbon fibers can be supplied directly from a carbon fiber production process to the chopping process of the present invention, or from a wound carbon fiber bundle. Therefore, whether or not the carbon fibers are to be twisted can be decided appropriately as required.

When the carbon fibers are to be twisted, the bobbin can be mechanically rotated by using power, to forcibly twist the carbon fibers, or the carbon fibers can be automatically twisted by unreeling them from the bobbin in the longitudinal direction. In the twisting caused by unreeling, the carbon fibers can be pulled from outside the bobbin or from inside the bobbin. Furthermore, depending on the process, a carbon fiber bundle impregnated with 0.1 to 2.0 wt % of a primary sizing agent, and dried for improvement of handling convenience, can also be used as a raw material for making chopped carbon fibers.

The sizing agent used in the present invention can be either a thermosetting resin or a thermoplastic resin, so long as the carbon fibers can be bundled.

The sizing agent which can be used here is, for example, one or more as a blend of urethane resins, epoxy resins, urethane modified epoxy resins, epoxy modified urethane resins, polyester resins, phenol resins, polyamide resins, polycarbonate resins, polyimide resins, polyether imide resins, bismaleimide resins, polysulfone resins, polyether sulfone resins, polyvinyl alcohol resin, polyvinyl pyrrolidone resin, and polyacrylic resins. Any of these resins is used as an aqueous dispersion or aqueous solution. The aqueous dispersion or aqueous solution can also contain a small amount of a solvent.

Among these resins, a urethane resin with an elastic modulus in tension of 1 to 30 MPa as measured in the form of a film is especially preferable. A urethane resin has excellent capability to bundle carbon fibers, and if the elastic modulus as a film is controlled, the bundle integrity becomes more preferable. If the elastic modulus as a film is less than 1 MPa, the effect of improving the bundle integrity is small, and if more than 30 MPa, the resin is fragile and likely to cause opening when stirred for the transfer from the hopper of the compounding process to an extruder, hence troubles.

The above elastic modulus in tension as a film is obtained by thinly casting an aqueous urethane sizing agent solution on a sheet, drying at room temperature for 24 hours, at 80° C. for 6 hours and furthermore at 120° C. for 20 minutes, to form a film about 0.4 mm thick, 10 mm wide and 100 mm long, pulling it at a speed of 200 mm/min for a tension test, and measuring the stress at an elongation of 100% in MPa.

Furthermore, in the present invention, it is preferable that the sizing agent is an epoxy resin. An epoxy resin is a sizing agent has excellent adhesiveness to the matrix resin and excellent heat resistance. The use of an epoxy resin alone is preferable, but the use of an epoxy resin together with a urethane resin is also preferable since the bundle integrity of the chopped carbon fibers can be further improved.

In the present invention, it is also preferable that the sizing agent is an acrylic resin. An acrylic resin is preferable as a sizing agent since it has good adhesiveness to the matrix resin and excellent heat resistance like an epoxy resin. The use of an acrylic resin alone is preferable, but the acrylic resin can also be used with a urethane resin or epoxy resin.

Moreover, to further improve the bundle integrity of short carbon fibers, it is also effective to add a reactive sizing agent such as a silane coupling agent in an amount of 0.05 to 3 wt %.

In the present invention, the urethane resin can be obtained by addition polymerization of a diisocyanate and a polyol with hydrogen atoms capable of reacting with isocyanate groups.

The diisocyanates which can be used include, for example, aromatic diisocyanates such as tolylene diisocyanate, naphthalene diisocyanate, phenylene diisocyanate, diphenylmethane diisocyanate and xylylene diisocyanate, and aliphatic diisocyanates such as 1,1,6-hexamethylene diisocyanate and hexane diisocyanate.

As for the polyol, a first group of polyols which can be used include polyether polyols with hydroxyl groups at the ends obtained by addition polymerization of one or more alkylene oxides such as ethylene oxide and tetrahydrofuran to a polyhydric alcohol such as ethylene glycol, propylene glycol, butylene glycol, glycerol, hexanediol, trimethylolpropane or pentaerythritol, alkylene oxide addition polymerization products of a polyhydric phenol such as resorcinol or bisphenol, alkylene oxide addition products of a polybasic carboxylic acid such as succinic acid, adipic acid, fumaric acid, maleic acid, glutaric acid, azelaic acid, phthalic acid, terephthalic acid, dimer acid or pyromellitic acid.

A second group of polyols which can be used include polyester polyols such as condensation products of a polyhydric alcohol and a polybasic carboxylic acid, condensation products of a hydroxycarboxylic acid and a polyhydric alcohol, etc., and the polyhydric alcohol and polybasic carboxylic acid can be selected from those stated above.

A third group of polyols which can be used include polyester ether polyols such as polyester polyethers with hydroxyl groups at the ends obtained by condensing by a polybasic carboxylic acid, a polyether obtained by addition-polymerizing an alkylene oxide to any of said polyesters, and polycarbonate urethane resins containing a polycarbonate polyol with a polycarbonate skeleton in the molecule as said polyol component, etc.

The epoxy resins which can be used preferably include epoxy resins obtained with an amine or phenol, etc. as the precursor.

Epoxy resins with an amine as the precursor include tetraglycidyl diaminediphenylmethane, triglycidyl-p-aminophenol, triglycidyl-m-aminophenol and triglycidyl aminocresol.

Epoxy resins with a phenol as the precursor include bisphenol A type epoxy resin, bisphenol F type epoxy resin, bisphenol S type epoxy resin, phenol novolak type epoxy resin, cresol novolak type epoxy resin and resorcinol type epoxy resin.

Since most epoxy resins are insoluble in water, they are used as aqueous dispersions. In this case, if a high molecular epoxy resin is used together with a low molecular epoxy resin, the dispersion stability improves. Furthermore, they preferably improve the flexibility of the fibers impregnated with a sizing agent, to improve process passability. Concretely a mixture consisting of a liquid epoxy compound with a molecular weight of 300 to 500 and a solid epoxy compound with a molecular weight of 800 to 2000 at a ratio by weight of 50:50~5:95 is preferable. If the amount of the liquid epoxy compound is too large, bundle integrity and heat resistance decline.

The acrylic resins which can be used include those mainly composed of an acrylic acid polymer, acrylate polymer or methacrylate polymer, and those obtained by modifying them, but are not limited to them. Concretely Primal HA-16, HA-8, E-356, etc. produced by Nippon Acryl Kagakusha can be used.

Preferable methods for applying a sizing agent in the present invention include dipping a running carbon fiber bundle in a sizing agent solution, bringing a sizing agent solution, deposited on the surface of a roller, into contact with a running carbon fiber bundle (kiss roll method), and feeding a sizing agent solution from holes or slits of a guide in contact with a running carbon fiber bundle (guide oiling method). Especially the guide oiling method is preferable to control the solution content and to control the form of the fiber bundle. If a sizing agent is discharged in a required amount from the holes or slits formed in a guide, the intended solution content can be easily achieved, and the width of the fibers can be stably controlled by the width of the guide. In this case, the number of guides can be one or more, and the sizing agent can be applied to one or both sides of a flat carbon fiber bundle. After applying the sizing agent, the fiber bundle can be rubbed by rollers while running, for easier permeation of the sizing agent solution deposited on the surface deep inside the fiber bundle. It is preferable that the fiber bundle is retained for 10 seconds or more after applying the sizing agent solution, since the permeation deep inside the fiber bundle is likely to be achieved.

A preferable solution content control method is to use a nozzle hole. In this method, the carbon fibers dipped in a sizing agent solution are passed through a nozzle hole with a predetermined diameter, to decide the solution content. In this case, it is preferable that the nozzle hole diameter is such that the value obtained by dividing the sectional area ($cm^2$) of the carbon fiber bundle calculated from the yield(g/m) and the specific weight of the carbon fibers, by the area ($cm^2$) of the nozzle hole is 0.4 to 0.7. According to this method, excess sizing agent solution deposited can be squeezed out and can permeate the fiber bundle deep inside uniformly.

Other solution content control methods include squeezing a sizing agent solution deposited carbon fiber bundle by nip rollers, and blowing away the excess sizing agent solution once deposited on the fiber bundle by the compressed air ejected from a nozzle hole.

The control of the tension and form, especially the control of the width of the fiber bundle after impregnation with a sizing agent solution till cutting is important since the control affects the flowability and bundle integrity of the chopped carbon fibers. So, various guides, grooved rollers, etc. are arranged to achieve the intended packing density in a range of 5,000 to 20,000 D/mm, before cutting. The packing density refers to the value obtained by dividing the total fineness (D) of the fiber bundle by the width of the fiber bundle (the dimension in a direction perpendicular to the fiber axis (mm)).

In the present invention, the packing density of the carbon fibers in a carbon fiber bundle must be kept in a range of 5,000 to 20,000 D/mm when the sizing agent is applied. If the packing density of carbon fibers is lower than 5,000 D/mm, it is difficult to keep the bundle integrity high even if the solution content is controlled, since the bundle integrity is dominated by the low packing density. If the packing density is higher than 20,000 D/mm, it takes time for the applied sizing agent solution to sufficiently permeate the fiber bundle deep inside, causing irregular impregnation in a continuous process, thus lowering the bundle integrity.

In the present invention, the solution content at the time of cutting should be 10 to 35 wt %, and the solution content before drying should 15 to 45 wt %. The reason why different solution contents are adopted is that the respective steps are different in the relation between the processability and the optimum solution content. The solution content at the time of cutting is selected to prevent the fiber bundle from disintegrating, in an extreme case, into single filaments by the shear force (opening action) applied by cutting, and that the chopped fibers adhere to the cutter blade. On the other hand, the solution content at the time of drying is selected to ensure that the surface tension of the solution acts to improve the integrity of the fiber bundle. If the solution content is larger, the surface tension is larger, and the bundle integrity after drying is higher.

For the above reasons, the solution content is controlled to be in a range of 10 to 35 wt % when the wet fibers are cut by a cutter into chopped carbon fibers. A preferable range is 15 to 25 wt %. If the solution content exceeds 35 wt %, chopped carbon fibers adhere to each other to lower flowability, and adhere to the cutter blade and rollers, and are liable to cause troubles in the cutting step. If the solution content is less than 10 wt %, the carbon fiber bundle is likely to be opened by the shear force applied by cutting, unpreferably. The solution content before drying must be controlled in a range of 15 to 45 wt %, preferably 25 to 35 wt %. If the solution content is more than 45 wt %, the drying load tends to be large and the dryer is likely to be contaminated, and if less than 15 wt %, the bundle integrity may decline.

As a further other feature of the present invention, it was found that even if water or a sizing agent solution is additionally applied also to the chopped carbon fibers, the bundle integrating effect can be manifested when water is evaporated. If the fiber bundle is cut at a low water content of less than 10 wt %, the fiber bundle is likely to be opened by the shear force applied by the cutter as described before, making it difficult to obtain chopped fibers having good bundle integrity, but if water or a sizing agent solution is additionally applied after cutting and before drying, the chopped carbon fibers obtained after drying having good bundle integrity. In this case, as a liquid additionally applied, water is best in view of cost, but any aqueous sizing agent expected to give a bundle integrating effect can be used. The aqueous sizing agent in this case refers to a water soluble sizing agent or aqueous emulsion, and it may also contain a small amount of an organic solvent.

In the present invention, the solution content refers to the rate of the weight of the sizing agent solution to the weight of dried carbon fibers.

In this case, the concentration of the sizing agent solution must be set to achieve an intended sizing agent deposition rate. Usually a concentration of 0.3 to 10 wt % is adopted.

For cutting wet fibers, any conventional cutter such as a rotary cutter like a roving cutter or guillotine cutter can be used. At the time of cutting, it is also preferable to use a brush, etc. for removing the chopped fibers which are going to adhere to or have adhered to rotating parts such as a roller. If the count of twist, packing density and solution content are kept in respectively proper ranges at the time of cutting, the chopped carbon fibers are separated in the fiber axis direction at a certain probability, and chopped fibers having improved flowability and bundle integrity can be obtained.

In the present invention, the chopped fibers are further dried in hot air while being vibrated, preferably in a fluidized state. If wet chopped carbon fibers are vibrated when dried in an oven, it can be prevented that bundles of the flat chopped carbon fibers adhere to each other, and they are separated along the fiber axis direction into less flat chopped carbon fibers, to assure higher flowability. It is preferable that the vibration frequency is 5 to 25 cycles/second and that the amplitude is 3 to 10 mm. The drying rate is also optimized to secure flowability.

The chopped carbon fibers so produced are separated along the fiber axis direction, and as a result, the individual fiber bundles constituting a set of chopped fibers, i.e., short fiber bundle pieces, vary to some extent in size, weight and number of component single filaments, but become small in the respective average values, and are improved in flowability.

If a fiber bundle is cut at a length of several millimeters, the form becomes cylindrical or flaky, though depending on the production method. Especially when a thick fiber bundle is used as a raw material, it usually becomes like a flat plate, especially an almost rectangular flat plate due to the process restrictions in sizing solution impregnation, cutting, etc. If the flatness of the plate form is higher, the flowability is lower. So, it is desirable that the flatness of the form is as low as possible.

The excellent flowability and bundle integrity of the chopped carbon fibers obtained by the present invention can be explained in reference to new technical findings by the inventors. The technical findings are described below.

As for indicators of flowability and bundle integrity, instead of using the bulk density or the angle of repose alone, it is best to use a value obtained by dividing the bulk density by the tangent of the angle of repose, as an indicator of flowability. However, since there is a problem that the measured angles of repose of chopped carbon fibers vary greatly, the inventors studied further and as a result, found that the formula $W_1^2/K \cdot W_2$ which is a substantially equivalent physical quantity, as compared to the value obtained by dividing the bulk density by the tangent of the angle of repose, can express flowability more accurately, and that when the value is in a specific range, especially excellent flowability can be secured.

It can be demonstrated, by the following numerical expressions, that the value obtained by dividing the bulk density by the tangent of the angle of response is a physical quantity equivalent to $W_1^2/K \cdot W_2$.

Bulk density$=W_1/V_1$ $V_1$: Volume (200 $cm^3$ in this case)

Angle of repose$=\tan^{-1}(h/r)$ h: Height from bottom to top in piling r: Radius of measuring table (4 cm in this case)

When the weight of the chopped fibers on the measuring table is $W_2$, the angle of repose can be expressed as follows:

$$W_2=(1/3)\times\pi\times r^2\times h\times(W_1/V_1)$$

Because of h=r×tan (angle of repose), tan (angle of repose) can be expressed by the following formula:

$$\tan(\text{angle of repose})=3W_2V_1(\pi r^3W_1)$$

Hence, the value obtained by dividing the bulk density by the tangent value of the angle of repose is as follows:

Bulk density/tan (angle of respose)

$$=(W_1/V_1)/(3W_1V_1/(\pi r^3W_1)=W_1^2/K\cdot W_2$$

If $V_1$ is 200 $cm_3$ and r is 4 cm, then we have $K=3V_1^2/(\pi r^3)=597$.

Since the measurement accuracy of $W_2$ is higher than that of the angle of repose, the above is very useful as an indicator of flowability.

General technical explanations about the angle of repose and bulk density are as follows.

The flowability of chopped fibers in a hopper under their own weight is determined by the friction coefficient between the wall and the fiber bundles, the friction coefficient between fiber bundles and fiber bundles, the pressure caused by the weight, and the shear stress generated on the wall. If the shear stress becomes higher than the frictional force, sliding begins and flowing occurs. The shear stress and the frictional force are physical quantities which can be approximated by the bulk density and the angle of repose respectively, though not directly. For this reason, the bulk density and the angle of repose have been used as property values of chopped carbon fibers.

The bulk density is decided by the density and deposition rate of the sizing agent applied to the chopped fibers and the density and voids of the carbon fibers, and the angle of repose is decided by the size, surface smoothness, hygroscopicity, form, etc. of the short fiber bundle pieces. So, the bulk density and the angle of response are values which can change independent of each other, and the above mentioned correlativity between the bulk density and the angle of repose is a phenomenon occurring under limited conditions.

When the chopped carbon fibers of the present invention are used as a reinforcing agent, an excellent carbon fiber reinforced resin can be produced.

The thermoplastic resins which can be suitably used as the matrix include almost all thermoplastic resins such as ABS, polyamides, polycarbonates, polyethylene terephthalate, polybutylene terephthalate, polyether imides, polysulfones, polyether sulfones, polyphenylene oxide, modified polyphenylene oxide, polyphenylene sulfide, polyether ketones, and alloys of these resins. A thermoplastic resin composition generally consists of 3 to 70 wt % of short carbon fibers bundled and treated as described above and 97 to 30 wt % of any of the above mentioned matrix resins.

The present invention is described below in more detail based on the examples.

At first, the measuring methods used in the present invention are described below.

[How to obtain the weight of a short fiber bundle piece]

Procedure 1. One hundred carbon fiber bundle pieces sampled at random were weighed by an electronic balance capable of weighing down to 0.1 mg, and the weight of the short fiber bundle pieces was averaged.

[How to obtain the average weight per unit length in the fiber length direction of short fiber bundle pieces]

Procedure 2. Cut lengths were measured, and the average value of the cut lengths was used to divide the individual values obtained in Procedure 1, for obtaining the average weight per unit length in the fiber length direction of short fiber bundle pieces. Then, the coefficient of variation (CV value=Standard deviation/Average value) was obtained.

[How to obtain the transverse lengths of short fiber bundle pieces]

The projected areas and circumferential measurements of the weighed carbon fiber bundle pieces were measured by image processing using a computer as described later, and the measurements in the direction perpendicular to the fiber axis direction were calculated using the circumferential measurements and the average cut length obtained in Procedure 2. The respective average values and coefficients of variation were obtained.

[Image processing]

The widths of chopped carbon fiber bundle pieces were evaluated by image processing using a computer for more accurate measurement. The computer used for the image processing was Macintosh 7600/132, and for scanning to enter the image, EPSON G-6000 was used. At first, the fiber bundle pieces were weighed one by one and placed on A-4 size paper side by side. The number of samples was 50 to 100. A glue was sprayed over them, to fix them, and a transparent film was stuck on them. Additionally, a black closed square accurately known in area, was attached for reference. Since units of image processing are pixels, a reference in millimeters is necessary for correction. It was placed on the image processor of EPSON G-6000, and entered into Abobe photoshop IM3.0J software for storage. Then, it was pasted on NIHimage1.55 software for image analysis. Since the software is not used for directly analyzing the width, the circumferential length was obtained in pixels by Perimeter/Length command, and corrected in millimeters in reference to the size attached for correction. From the corrected value, the width of both sides of the cut piece was subtracted, and the remaining value was divided by 2, to obtain the side width by image analysis. Other image processing methods are available for evaluation and can be used without any problem, if they can be compared with this method.

$W_1$ and $W_2$, necessary for calculating the flowability indicator were measured as follows.

[How to obtain $W_1^2/K \cdot W_2$]

(1) Measurement of $W_1$: Two hundred cubic centimeters of short fiber bundles were supplied into a 500 cc measuring cylinder which was then dropped from a height of 3 cm ten times. The graduation at the top of the short fiber bundles in the measuring cylinder was read to obtain the volume, and the weight of the 200 cc volume after drop packing was obtained by proportional calculation as $W_1$ (g).

(2) Measurement of $W_2$: A sample was allowed to drop little by little onto the center of a smooth and clean horizontal measuring table with a diameter of 8 cm and a height of 5 cm, and when the sample simply fell from the measuring table without piling on the measuring table any more, the weight of the sample on the measuring table was measured as $W_2$ (g). The sample was allowed to drop on the measuring table, with a height of 1 to 2 cm kept above the top of the piled sample.

(3) $W_1^2/K \cdot W_2$ was calculated according to the ordinary method.

[Evaluation of bundle integrity]

The bundle integrity was tested by forced stirring. Into a 1000 cc beaker, 200 cc of short carbon fibers were supplied, and stirred by a stirring motor at 100 rpm for 30 minutes, and the bulk density was measured and calculated according to the above mentioned method. A bulk density of 0.4 g/cm$^3$ or less was judged to have poor bundle integrity.

[Evaluation of flowability]

When the fiber content of the molded product obtained by actual production equipment could not be controlled stably at a desired value, the flowability was judged to be poor.

EXAMPLE 1

A substantially non-twisted carbon fiber bundle consisting of 70,000 filaments with a total fineness of 49,500 D, impregnated with 1.5 wt % of an epoxy sizing agent (obtained by dispersing a mixture consisting of equal amounts of Ep828 and Ep1001, respectively bisphenol A diglycidyl ethers produced by Yuka Shell, into water using an emulsifier) as a primary sizing agent was dried and wound around a bobbin, to have a yield of 5.5 g/m, and it was unwound at a speed of 15 m/min and introduced into a bath containing 5% in purity of a water-dispersed urethane sizing agent with a tensile modulus in tension of 1.5 MPa at an elongation of 100% as a film, to be impregnated with the sizing agent. Then, the bundle was squeezed by a nozzle with a hole diameter of 2.6 mm, to be adjusted to have a solution content of 30% and a fiber bundle width of 8,300 D/mm. The fibers were introduced into a roving cutter, and cut at a length of 6 mm. The chopped fibers with a solution content of 30% were dried in an oven at 190° C. for 5 minutes while the woven metallic wire in it was vibrated at a vibration frequency of 16 cycles/second at an amplitude of 6 mm, to obtain chopped fibers with a sizing agent deposition rate of 3.2 wt %. Their processability was tested using an extruder with a 0.3 m hopper. The flowability was good, and the chopped fibers could be processed without any problem in view of fiber content control stability. The results are shown in Table 1.

EXAMPLE 2

Figures 1, 2:
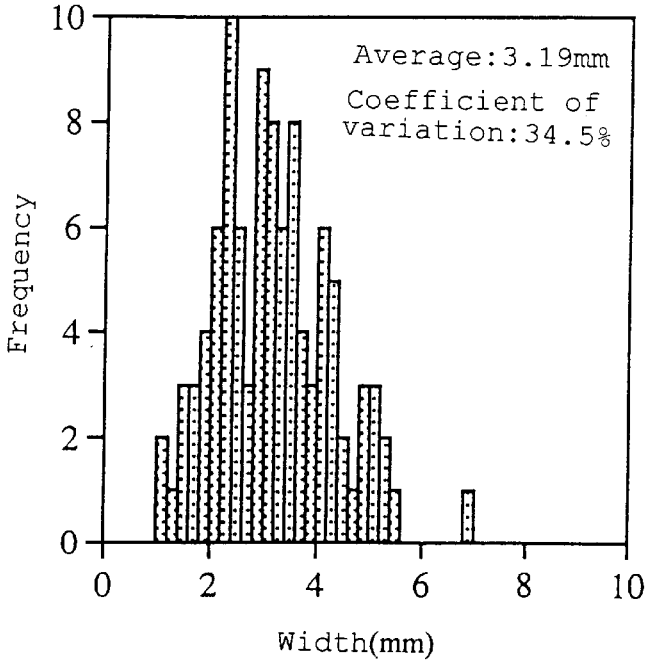
Figures 1, 2:
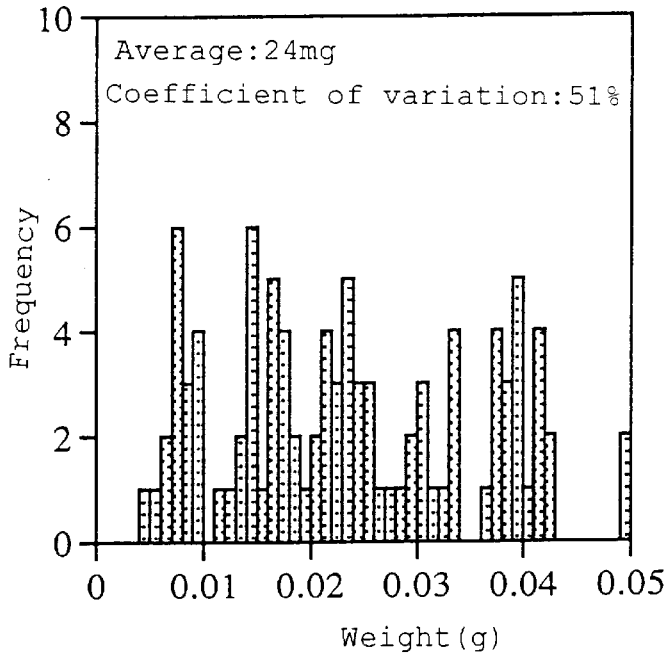
Figure 2:
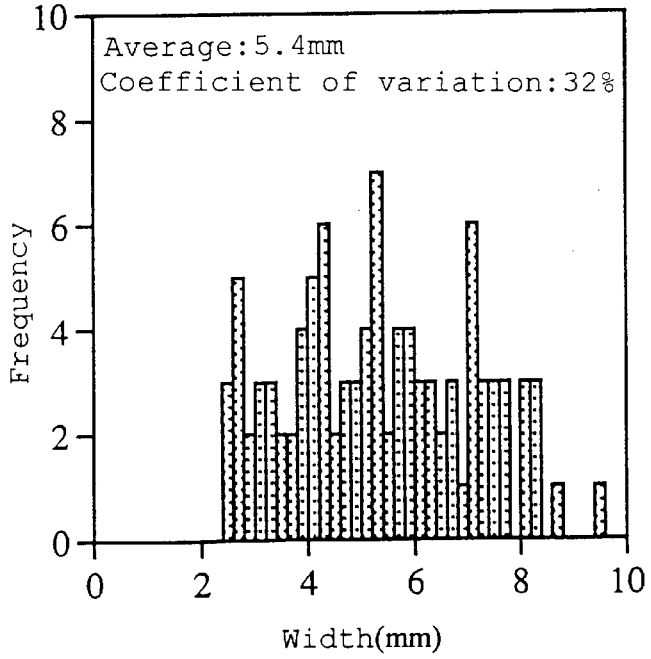

A substantially non-twisted carbon fiber bundle consisting of 70,000 filaments with a total fineness of 49,500 D, impregnated with 1.5 wt % of an epoxy sizing agent (obtained by dispersing a mixture consisting of equal amounts of Ep828 and Ep1001, respectively bisphenol A diglycidyl ethers, produced by Yuka Shell into water using an emulsifier) as a primary sizing agent was dried and wound around a bobbin, to have a yield of 5.5 g/m, and it was unwound at a speed of 15 m/min and driven to run at a tension of 2 kg in contact with a guide oiler having a 10 mm wide and 100 mm long groove. From the oiling slit of the guide oiler, a sizing agent solution was metered and supplied to achieve a solution content of 30 wt %, for applying the same sizing agent as used in Example 1 to the carbon fibers. Then, the carbon fibers were rubbed by five rollers arranged in zigzag, adjusted to have a fiber bundle width of 8,300 D/mm, and introduced into a roving cutter, to be cut at a length of 6 mm. The chopped fibers with a solution content of 30% were dried in an oven at 190° C. for 5 minutes while the woven metallic wire in it was vibrated at a vibration frequency of 16 cycles/second at an amplitude of 6 mm, to obtain chopped fibers impregnated with 3.2 wt % of the sizing agents. Their processability was tested using an extruder with a 0.3 $m^3$ hopper. The flowability was good, and the chopped fibers could be processed without any problem of fiber content control stability. The results are shown in Table 1. The distributions of weights and widths of the short fiber bundle pieces are shown in FIGS. 1-1 and 1-2.

EXAMPLE 3

Chopped fibers were obtained as described in Example 2, except that the vibration during drying was effected at a vibration frequency of 16 cycles/second at an amplitude of 3 mm. Their processability was tested using an extruder with a 0.3 $m^3$ hopper. The flowability was rather lower than that in Example 2, but the chopped fibers could be processed without any problem of fiber content control stability. The results are shown in Table 1. The distributions of weights and widths of the short fiber bundle pieces are shown in FIGS. 2-1 and 2-2.

EXAMPLE 4

A substantially non-twisted carbon fiber bundle consisting of 70,000 filaments with a total fineness of 49,500 D, impregnated with 1.5 wt % of an epoxy sizing agent (obtained by dispersing a mixture consisting of equal amounts of Ep828 and Ep1001, respectively bisphenol A diglycidyl ethers, produced by Yuka Shell into water using an emulsifier) as a primary sizing agent, was dried and wound around a bobbin, to have a yield of 5.5 g/m, and it was unwound at a speed of 15 m/min and driven to run at a tension of 2 kg in contact with a guide oiler having a groove 10 mm wide and 100 mm long. From the oiling slit of the guide oiler, a sizing agent solution was metered and supplied to achieve a solution content of 20 wt %, for applying the same sizing agent as used in Example 1 to the carbon fibers. Then, the carbon fibers were rubbed by five rollers arranged in zigzag, adjusted to have a fiber bundle width of 8,300 D/mm, and introduced into a roving cutter, and cut at a length of 6 mm. Then, on a woven metallic wire in an oven, the cut fibers were spread and water was sprayed uniformly over the cut fibers, to achieve a solution content of 30 wt % including the sizing agent solution applied before. Subsequently they were dried as described in Example 2, to obtain chopped fibers impregnated with 3.5 wt % of the sizing agents. Their processability was tested using an extruder with a 0.3 $m^3$ hopper, and the chopped fibers could be processed without any problem of fiber content control stability. The results are shown in Table 1.

EXAMPLE 5

Chopped carbon fibers impregnated with 1.5 wt % of a sizing agent were obtained as described in Example 4, except that the primary sizing agent was not applied. Their processability was tested using an extruder with a 0.3 $m^3$ hopper, and the carbon fibers could be processed without any problem, almost as in Example 4.

EXAMPLE 6

Chopped fibers impregnated with 3.3 wt % of sizing agents were obtained as described in Example 2, except that the sizing agent applied by the guide oiler was an acrylic resin (Primal HA-8 produced by Nippon Acryl Kagakusha). They were compounded with a nylon resin using an extruder with a 0.3 $m^3$ hopper. The flowability in the hopper was good, and no problem occurred of fiber content control stability. The results are shown in Table 1.

COMPARATIVE EXAMPLE 1

Figures 1, 3:
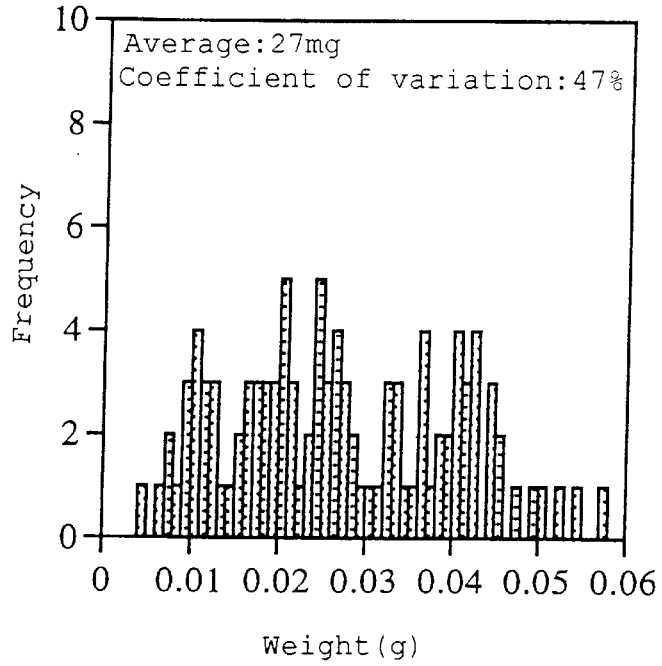
Figures 2, 3:
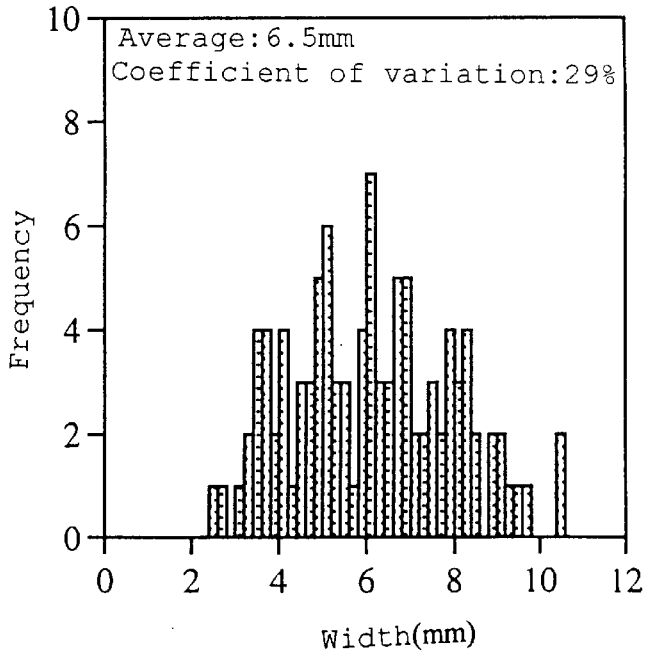

Chopped fibers were obtained as described in Example 2, except that the drying was effected without vibration. Their processability was tested using an extruder with a 0.3 $m^3$ hopper. The flowability was poor, and blocking occurred frequently, not allowing stable processing. The results are shown in Table 1. The distributions of weights and widths of the short fiber bundle pieces are shown in FIG. 3.

COMPARATIVE EXAMPLE 2

Chopped carbon fibers were obtained as described in Example 2, except that the fiber bundle width was adjusted to 3,300 D/mm. Their processability was tested using an extruder with a 0.3 $m^3$ hopper. The flowability was so low as not to allow processing at all. The results are shown in Table 1.

EXAMPLE 7

Chopped carbon fibers were obtained as described in Example 2, except that the fiber bundle width was adjusted to 5,800 D/mm. Their processability was tested using an extruder with a 0.3 m hopper. The flowability was rather lower than that in Example 2, but the chopped fibers could be processed without any problem of fiber content control stability. The results are shown in Table 1.

EXAMPLE 8

Chopped fibers were obtained as described in Example 2, except that the sizing agent solution was metered and supplied to achieve a solution content of 35 wt % at the time of cutting before drying. Since the chopped carbon fiber pieces adhered to the blade at the time of cutting, a brush was attached to scrape off the adhering carbon fibers, to allow cutting continuously. Their processability was tested using an extruder with a 0.3 $m^3$ hopper. The flowability was good, and the chopped fibers could be processed without any problem of fiber content control stability. The results are shown in Table 1.

EXAMPLE 9

Chopped fibers were obtained as described in Example 2, except that the sizing agent solution was metered and supplied to achieve a solution content of 20 wt % at the time of cutting before drying. The chopped carbon fiber pieces did not adhere to the blade at the time of cutting, to show very good cutting processability. Their processability was tested using an extruder with a 0.3 $m^3$ hopper. The flowability was rather lower than that in Example 5, but the chopped fibers could be processed without any problem of fiber content control stability. The results are shown in Table 1.

TABLE 1

| | Before cutting | | Before drying | | results of chopped fiber set | | | | | | | |
|---|---|---|---|---|---|---|---|---|---|---|---|---|
| No | Solution content % | Packing density KD/mm | Solution content % | Drying Amplitude mm | Average weight (mg) Coefficient of variation (%) | A* (mg/mm) (Coefficient of variation) | B* (%) | C* (%) | D* (mm) (Coefficient of variation) | E* | Flow-ability | Bundle integrity |
| Example 1 | 30 | 8.3 | 30 | 6 | 12.8 (50%) | 2.1 (50%) | 4 | 4 | 3.2 (34%) | 0.8 | Good | Good |
| Example 2 | 30 | 8.3 | 30 | 6 | 12.9 (50%) | 2.2 (50%) | 3 | 5 | 3.2 (35%) | 0.8 | Good | Good |
| Example 3 | 30 | 8.3 | 30 | 3 | 24 (51%) | 4 (51%) | 4 | 9 | 5.4 (32%) | 0.7 | Good | Good |
| Example 4 | 20 | 8.3 | 30 | 6 | 13.3 (50%) | 2.5 (50%) | 4 | 7 | 4.3 (32%) | 0.8 | Good | Good |
| Example 6 | 30 | 8.3 | 30 | 6 | 20 (50%) | 2.3 (53%) | 3 | 5 | 4.5 (35%) | 0.6 | Good | Good |
| Comparative Example 1 | 30 | 8.3 | 30 | 0 | 27 (47%) | 4.5 (47%) | 2 | 6 | 6.5 (29%) | 0.45 | Poor | Good |
| Comparative Example 2 | 30 | 3.3 | 30 | 6 | 4.9 (58%) | 0.8 (58%) | 12 | 6 | 2.5 (43%) | 0.4 | Poor | Poor |
| Example 7 | 30 | 5.8 | 30 | 6 | 10.4 (57%) | 1.7 (57%) | 8 | 5 | 3.8 (37%) | 0.53 | Good | Good |
| Example 8 | 35 | 8.3 | 35 | 6 | 17.9 (46%) | 3 (46%) | 4 | 3 | 4.0 (31%) | 0.85 | Good | Good |
| Example 9 | 20 | 8.3 | 20 | 6 | 11.2 (52%) | 1.9 (52%) | 4 | 4 | 2.8 (37%) | 0.75 | Good | Good |
| Comparative Example 3 | 10 | 8.3 | 10 | 3 | 9.6 (63%) | 1.6 (63%) | 7 | 14 | 2.4 (46%) | 0.37 | Poor | Poor |

A*: Average weight per unit length in fiber length direction
B*: Rate of the number of short fiber bundle pieces respectively with a weight of not smaller than twice the average weight, to the total number
C*: Rate of the number of short fiber bundle pieces respectively with a weight of not larger than ⅓ of the average weight, to the total number
D*: Average side length of short fiber bundle pieces
E*: $W_1^2/(597 \times W_1)$

COMPARATIVE EXAMPLE 3

A substantially non-twisted carbon fiber bundle consisting of 70,000 filaments with a total fineness of 49,500 D, impregnated with 1.5 wt % of an epoxy sizing agent (obtained by dispersing a mixture consisting of equal amounts of Ep828 and Ep1001, respectively bisphenol A diglycidyl ethers, produced by Yuka Shell into water using an emulsifier) as a primary sizing agent was dried and wound around a bobbin, to have a yield of 5.5 g/m, and it was unwound at a speed of 15 m/min and driven to run at a tension of 2 kg in contact with a guide oiler having a 10 mm wide and 100 mm long groove. From the oiling slit of the guide oiler, a sizing agent solution of 10 wt % in purity was metered and supplied to achieve a solution content of 10 wt %, for applying the same sizing agent as used in Example 1 to the carbon fibers. Then, the carbon fibers were rubbed by five rollers arranged in zigzag, adjusted to have a fiber bundle width of 8,300 D/mm, and introduced into a roving cutter, to be cut at a length of 6 mm. The chopped fibers with a solution content of 10% were dried in an oven at 190° C. for 5 minutes while a woven metallic wire in it was vibrated at a vibration frequency of 16 cycles/second at an amplitude of 3 mm, to obtain chopped fibers impregnated with 2.4% of sizing agents. Their processability was tested using an extruder with a 0.3 $m^3$ hopper. The flowability was so low as not to allow processing at all. The results are shown in Table 1. When the drying conditions as described in Example 1 were adopted, a problem in the processing occured that some were scattered as single filaments out of the system.

COMPARATIVE EXAMPLE 4

Chopped fibers were produced as described in Example 1, except that the solution content at the time of cutting before drying was set at 45 wt %. The chopped fibers adhered around the cutter blade, to cause frequent wrong cutting, and any desired chopped carbon fibers could not be obtained.

COMPARATIVE EXAMPLE 5

Chopped fibers were produced as described in Example 4, except that the sizing agent solution was applied from the guide oiler to achieve a solution content of 7 wt % at the time of cutting, and that water was sprayed over the chopped fibers uniformly by a spray, to achieve a solution content of 40 wt % including the sizing agent solution applied before, before drying. The chopped carbon fiber bundle pieces finely separated by the impact of cutting were joined at the time of, cutting. Their processability was tested using an extruder with a 0.3 $m^3$ hopper. The flowability was unstable, and there was a problem in supply stability.

What is claimed is:

1. A bundle of chopped carbon fibers, said fibers being impregnated with a sizing agent, said fibers constituting a bundle having an average weight per unit length of 1.7 to 4 mg/mm in the fiber length direction, and having a distribution coefficient of variation of 30 to 60% of weight per unit length in the fiber length direction.

2. A bundle of chopped carbon fibers according to claim 1, wherein the ratio of the number of bundle fibers which have a weight equal to or more than double the average weight of all of the fibers, to the number of bundle fibers which have a weight of equal to or smaller than ⅓ of the average weight of all of the fibers, is less than 10%.

3. Bundles of chopped carbon fibers according to claim 1, wherein the fiber bundles are substantially rectangular in cross-sectional form, and vary in side length, and wherein the average value of the side length of said bundles is in the range of 1.5 to 6 mm, and wherein the coefficient of variation of the side length is in the range of 25 to 40%.

4. Bundles of chopped carbon fibers according to claim 2, wherein the fiber bundles are substantially rectangular in cross-sectional form, and vary in side length, and wherein the average value of the side length of said bundles is in the range of 1.5 to 6 mm, and wherein the coefficient of variation of the side length is in the range of 25 to 40%.

5. A bundle of chopped carbon fibers according to any one of claims 1–4, wherein the sizing agent is selected from the group consisting of one or more of urethane resins, acrylic resins and epoxy resins.

6. A bundle of chopped carbon fibers, characterized by having the following property:

$$0.5 \leqq W_1^2/(K \cdot W_2) \leqq 1.5, \text{ where}$$

K is a constant=597, $W_1$ is the weight of carbon fibers when packed in a container that has a capacity of 200 cc (g), and wherein $W_2$ is the maximum weight of carbon fibers capable of piling on a flat round measuring table made of stainless steel having a diameter of 8 cm.

7. A bundle of chopped carbon fibers according to any one of claims 1–4, which have the following property:

$$0.5 \leqq W_1^2/(K \cdot W_2) \leqq 1.5, \text{ where}$$

K is a constant=597, $W_1$ is the weight of carbon fibers when packed in a container that has a capacity of 200 cc (g), and wherein $W_2$ is the maximum weight of carbon fibers capable of piling on a flat round measuring table made of stainless steel having a diameter of 8 cm.

* * * * *